US005664877A

United States Patent [19]

Wu

[11] Patent Number: 5,664,877

[45] Date of Patent: Sep. 9, 1997

[54] DECORATIVE LAMP STRING ASSEMBLY

[76] Inventor: Jeng-Shyong Wu, Fl. 4, No. 5, Hsing Shyue Road, Hsin-Chu City, Taiwan

[21] Appl. No.: 389,021

[22] Filed: Feb. 15, 1995

[30] Foreign Application Priority Data

Apr. 1, 1994 [CN] China ..... 92 2 07502.1

[51] Int. Cl.[6] ..... F21P 1/02

[52] U.S. Cl. ..... 362/252; 362/249; 362/806; 362/123

[58] Field of Search ..... 362/219, 220, 362/226, 238, 249, 250, 251, 252, 806, 123; 439/502, 505, 506; 206/419, 420, 421; 248/314, 316.7, 903

[56] References Cited

U.S. PATENT DOCUMENTS 4,228,896 10/1980 Wu ..... 206/420
5,027,262 6/1991 Freed ..... 362/249
5,045,981 9/1991 Nagano ..... 362/249
5,513,081 4/1996 Byers ..... 362/249
5,526,246 6/1996 Liou ..... 362/806

*Primary Examiner*—Ira S. Lazarus
*Assistant Examiner*—Thomas M. Sember
*Attorney, Agent, or Firm*—Bucknam and Archer

[57] ABSTRACT

A decorative lamp string assembly includes a plurality of lamps, lamp bases or sockets, electrical wires supports and clamping sockets each with an open end. The support is inserted from the open end of the clamping socket into the inner space thereof, and then the lamps, lamp bases or sockets are fitted securely into the inside of the clamping socket. Thus various decorative lamp string assemblies can be formed.

24 Claims, 7 Drawing Sheets

DECORATIVE LAMP STRING ASSEMBLY

BACKGROUND OF THE INVENTION

The invention relates to a decorative lamp string assembly, particularly a positioning structure of the decorative lamp string comprising a supporting strut and clamping sockets for forming a multi-direction lamp string column.

A structure relating to the present invention and positioning the lamps of decorative lamp string on a support is shown in FIG. 1. The support 100 made of hard material has two U-shape clamping sockets 101*a* and 101*b* at its two ends. By using these two U-shape clamping sockets 101*a* and 101*b*, two lamps can be clamped in lamp socket 102. In such a way, a lamp string in two lamps as a unit can be fixed through a plurality of supports, wherein an electrical wire is used to connect two sets of supports.

SUMMARY OF THE INVENTION

The object of the present invention mainly relates to a support assembly for positioning lamps of a decorative lamp string. The support assembly includes long support(s) and a plurality of U-shape clamping socket with an open end, wherein the support is fitted from the open end of the clamping socket into the inner space thereof and fixed, and then a lamp, a lamp base or a lamp socket is fitted into the inside of the clamping socket to construct a lamp string assembly accordingly.

Another object of the present invention is to provide U-shape clamping sockets where in the inner part of the socket, a flange is formed against the upper edge of the support fitted therein, so as to prevent the clamping socket from coming off from the support.

Another object of the present invention is to provide a support where a series of flanges are formed along each edge of the two longitudinal sides of the support, so as to prevent the clamping sockets from moving along the support.

Another object of the prevent invention is to provide dual or multiple composite U-shape clamping sockets each with open end in the same direction. Which may simultaneously or individually clamp a lamp, a lamp base or a lamp socket.

Another object of the present invention is to provide dual or multiple composite U-shape clamping sockets each with open end in the different direction, corresponding to fit the dual or plurality of the supports and clamping the lamp, lamp base or lamp socket thereon.

Another object of the present invention is to provide a plurality of supports provided with dual or multiple U-shape clamping sockets with open ends in the different direction, constructing a decorative lamp string column in solid pattern.

The various features of novelty which characterize the invention are pointed out with particularity in the claims annexed to and forming a part of this disclosure. For a better understanding of the invention, its operative advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
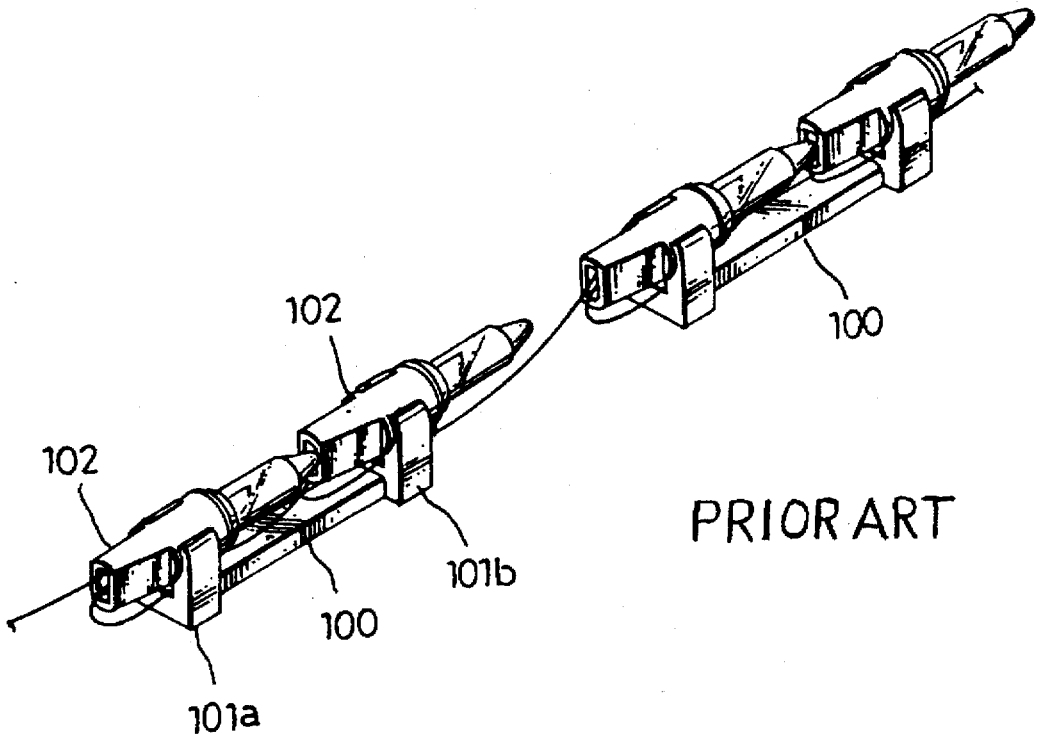
FIG. 1 is a perspective view of a part of a conventional lamp string using discontinuous short support for positioning.
Figure 2:
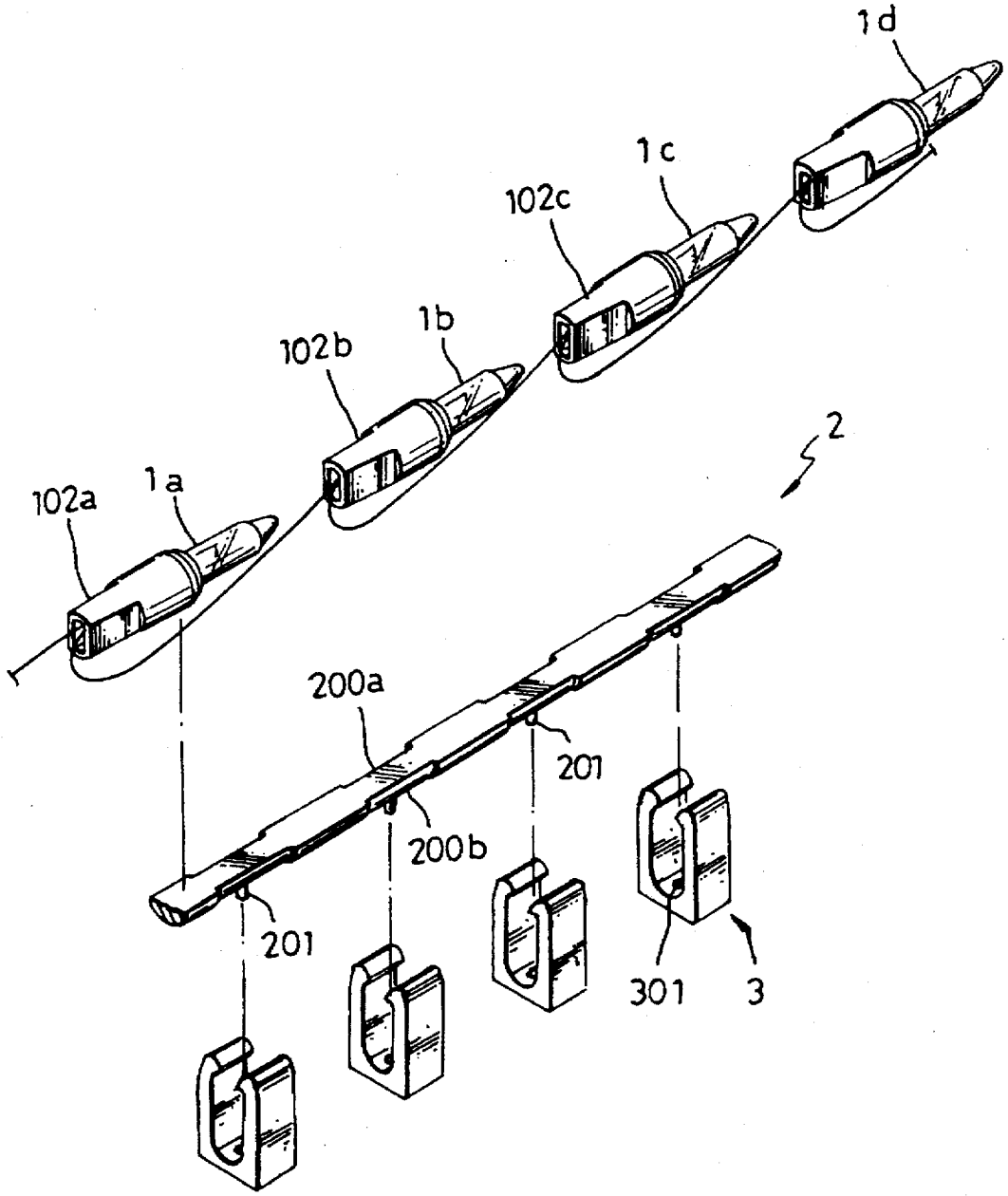
FIG. 2 is a perspective view of the first embodiment of the present invention showing its parts in their relative position.

The support assembly according to the first embodiment of the present invention is shown in FIG. 2, in which a lamp string 1 in series connection of lamps 1*a*, 1*b*, 1*c* and 1*d*, a strut support 2 and a plurality of clamping sockets 3 are included. Generally, the support 2 is made of plastic material and has rigidity. Along the two longitudinal side edges of support 2, recess 200*a* and 200*b* are formed at the set position, and pillars 201 each vertically projected from bottom face of support, 2 between recess 200*a* and 200*b* are formed. Clamping socket 3 is in the form of a U-shape body with open end. The section of inner space formed and surrounded by upper bottom and two side walls is the same as the sectional shape of support 2, two tips of the side walls bend inward, and a hole 301 is formed at the bottom to be fitted securely with pillar 201 of the support 2.

In the present invention, when the recesses of support 2 are engaged with the open end of each clamping socket, the two side edges of support 2 can be clamped securely by the two side walls of clamping socket 3, at the same time pillar 210 on support 2 and hole 301 on clamping socket 3 are also mutually engaged, so that clamping socket 3 and support 2 can be tightly integrated. Then lamp sockets 102*a*, 102*b*, 102*c* of lamps 1*a*, 1*b*, 1*c* . . . can be fitted inside clamping socket 3 and the inwardly bending of the two tips in socket 3 can prevent the lamp sockets 102*a*, 102*b*, 102*c* . . . from slipping out of the open ends of sockets 3.

Figure 3:
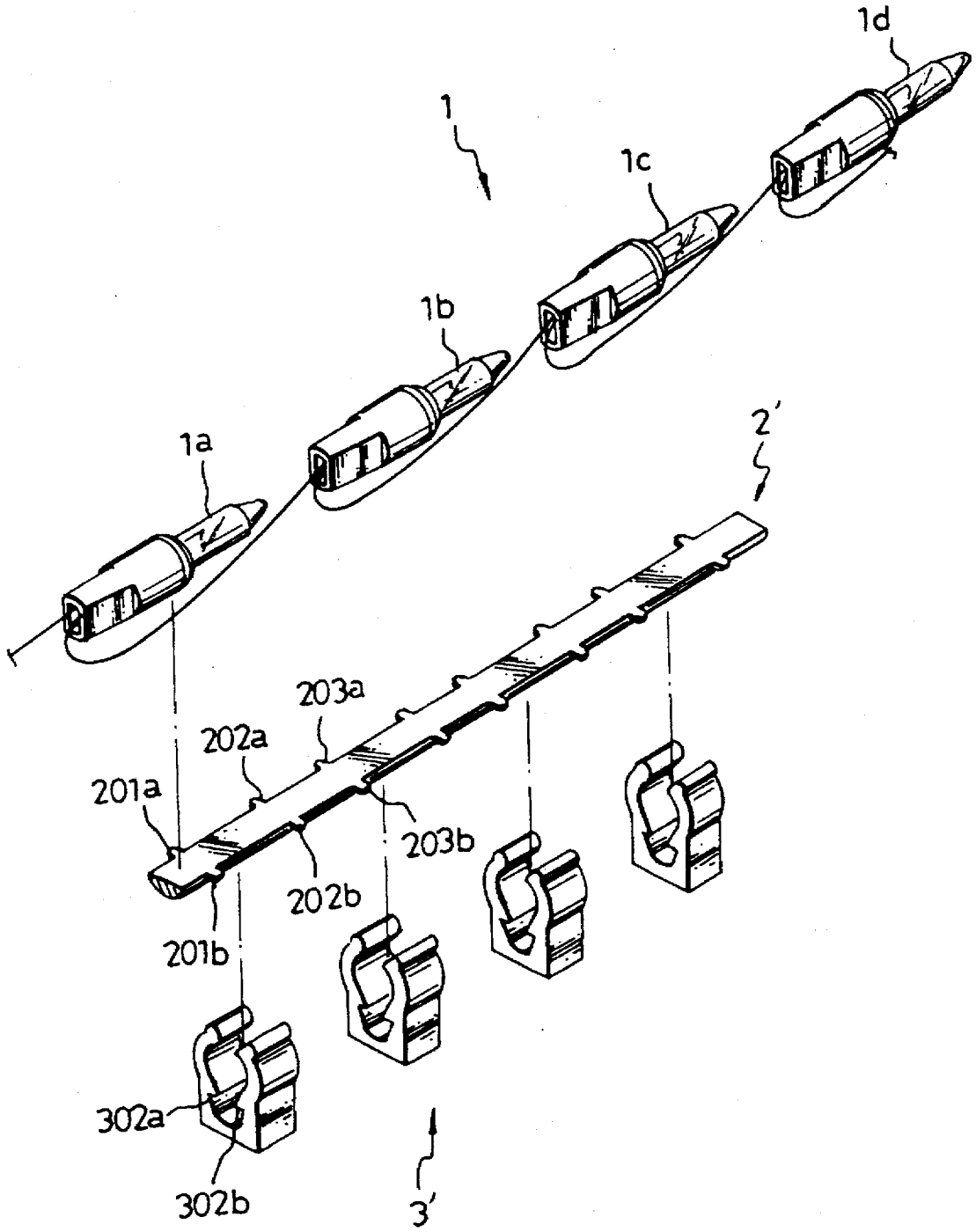
FIG. 3 is a perspective view of the second embodiment of the present invention showing its parts in their relative position.
Figure 4:
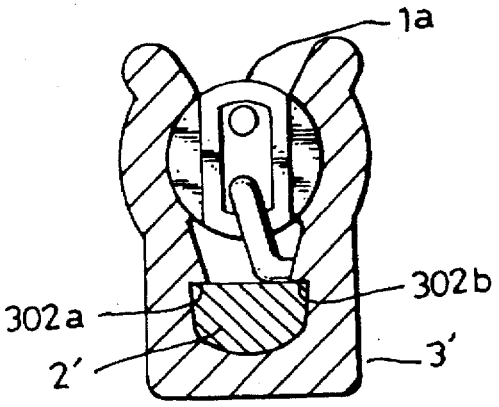
FIG. 4 is an enlarged left-end view of combination of each part of FIG. 3.

The second embodiment according to the present invention is shown in FIG. 3. Flanges (201*a*, 201*b*), (202*a*, 202*b*), (203*a*, 203*b*) . . . are respectively provided along the upper edges of the two sides of support 2', and the function is similar to the recesses in FIG. 2 to prevent clamping sockets in the recesses from moving back and forth on support 2, and no pillar is set on the bottom of support 2'. Clamping socket 3' is a U-shape body with open end, in its inner space, two flanges 302*a* and 302*b* are projected respectively on the inner sides of two branches to divide the space into two parts. The space section positioning above the top surface of the flanges is in accordance with the lamp socket cross section. Further, two tips of the free end bend inwardly to engage closely with the lamp socket which will be inserted into the upper inner space so as to render the support difficult to slip out again from the opening of the clamping socket. The lower space cross section is similar to the cross section of support 2', when clamping socket 3' is inserted into support 2', the shape under the bottom surfaces of the flanges is tightly combined with the support. Also, the bottom faces of flanges 302*a* and 302*b* can be set against the upper edges of the two sides of the support 2', as shown in FIG. 4. The top face of the flanges is made to be an inclined surface so as to make support 2' easy to slip into the lower space of the clamping socket 3'; and the bottom face of the flanges is shaped to be a horizontal plane so as to be well against the upper side edge of support 2'.

Figure 5:
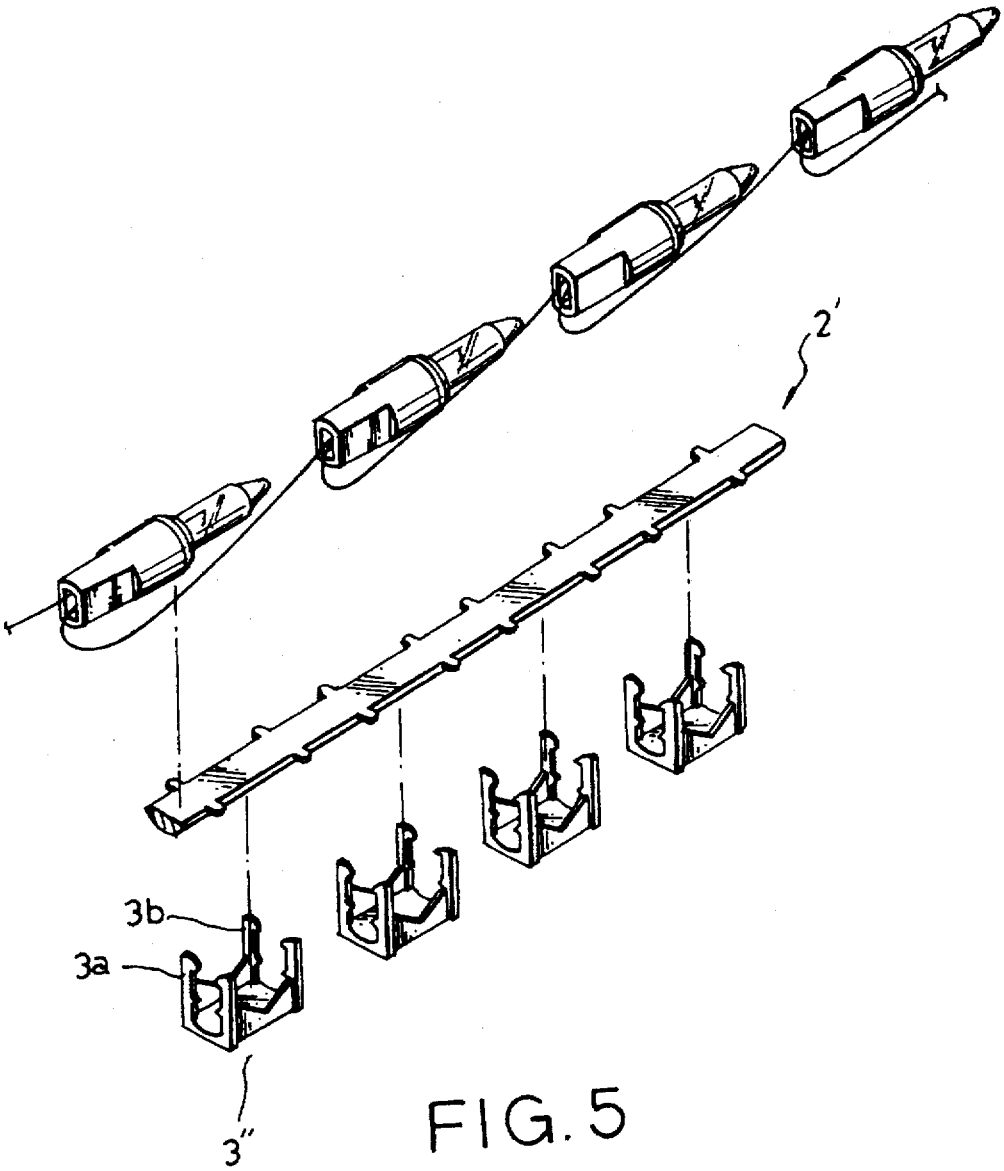
FIG. 5 shows the third embodiment according to the present invention, wherein the clamping socket forms in dual U-shapes end with an open end in the same direction.
Figure 6:
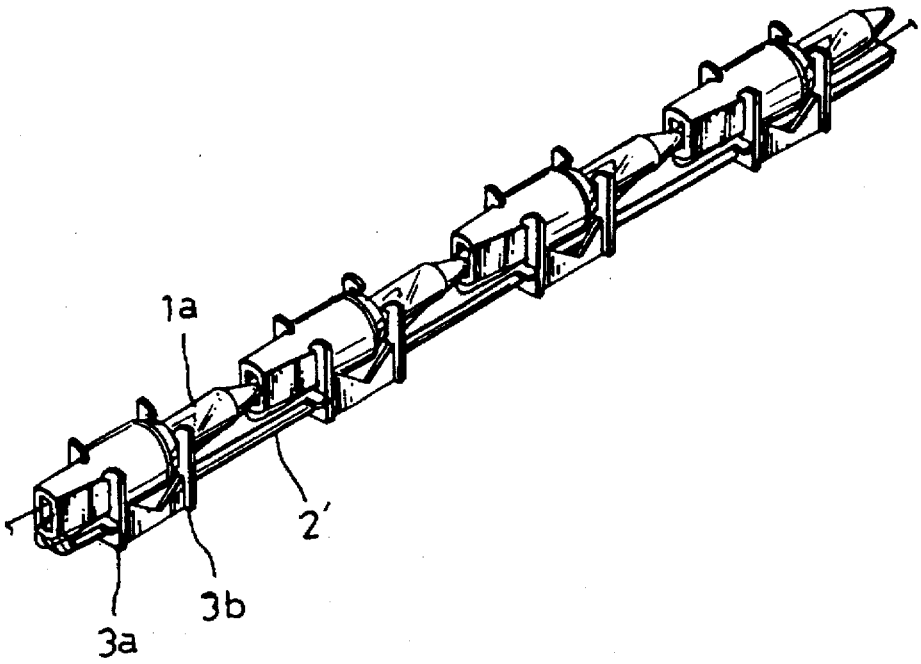
FIG. 6 is a perspective view of combination of each part according to FIG. 5.

The third embodiment according to the present invention is shown in FIG. 5, in which clamping socket 3" forms dual U-shapes with open ends in the same direction. The inside structures of each branch U-shape clamping socket 3*a*, 3*b* are similar to those shown in FIG. 3 and FIG. 4 and the functions are also the same. However, a base plate is used for connecting the two branch clamping sockets 3*a* and 3*b* together. As shown in FIG. 6, after engagement of clamping socket 3" with support 2', the lamp socket can be clamped by one branch clamping socket 3*a*, and the front end of the lamp socket can be placed against another branch clamping socket 3*b*; or the lamp socket can be clamped at the same time by both branch clamping sockets 3*a* and 3*b*.

Figure 7:
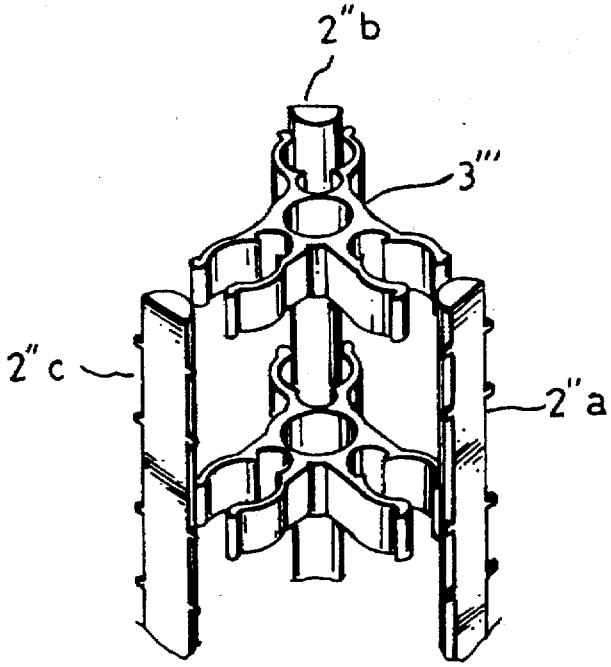
FIG. 7 shows the fourth embodiment according to the present invention, wherein the clamping socket forms in multiple U-shapes each with open end in the different direction.

The fourth embodiment according to the present invention is shown in FIG. 7, in which each clamping socket assembly 3''' is formed by gathering altogether multiple clamping sockets with open ends, in different direction, (as shown in FIG. 2 and FIG. 5).

In FIG. 7, three branch clamping sockets 3"*a*, 3"*b* and 3"*c* separated at 120 degree are taken for example. For assembling, three supports 2"*a*, 2"*b* and 2"*c* are pressed individually into the corresponding branch clamping sockets. Accordingly, the three supports and plural clamping socket 3''' are combined to be a column body. When the lamp bases in the lamp string are pressed into each branch clamping socket 3"*a*, 3"*b* and 3"*c* lamp and thereby to be clamped, a decorative lamp string in pattern with 3-D is formed.

Figure 8A:
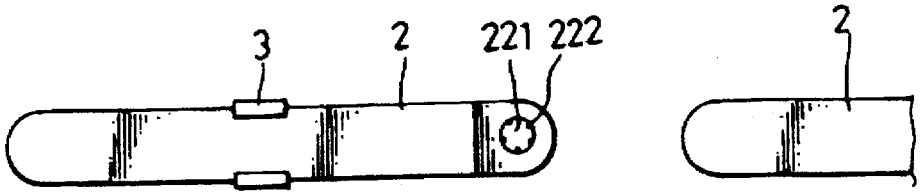
FIGS. 8A and 8B show the perspective view of the support assembly before combination.
Figure 8B:
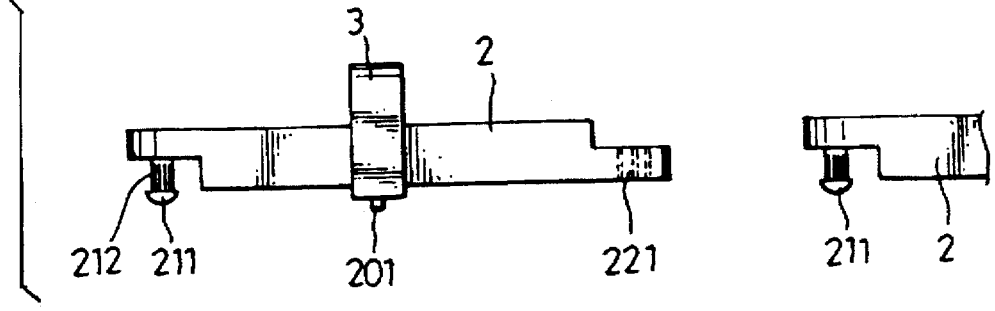

Referring now to FIGS. 8A and 8B, yet an embodiment for combination of support according to the present invention, it is shown that each support 2 can be connected via the connected parts (as shown in FIG. 8B) located at the two ends of support having a hole 221 or a pillar 211. There is a flange 222 in the inner space of the hole 221 or a flange 212 on the outer space of the pillar. Further, the two ends of the support 2 have a flange (not shown) in the inner space of the hole or have a concavity (not shown) on the outer space of pillar so as to prevent the support from moving or coming off.

Figure 9A:
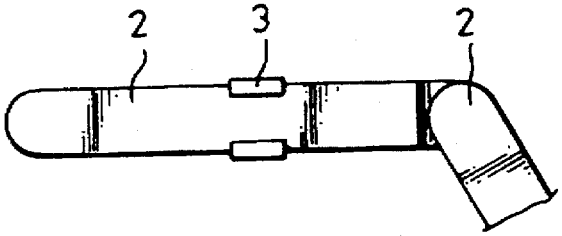
FIGS. 9A and 9B show the perspective view of the combination of each support assembly.
Figure 9B:
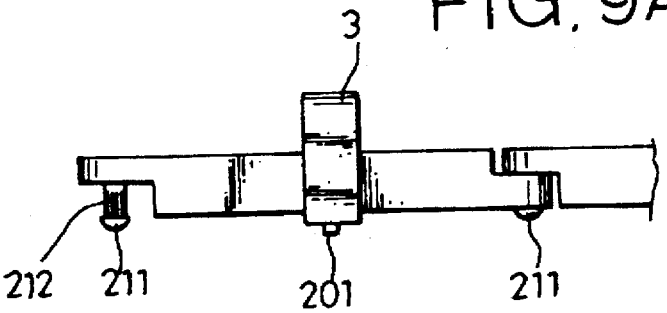

Referring now to FIGS. 9A and 9B, the combination of support according to the present invention, permits the two adjacent supports 2 to be moved as desired.

Figure 10:
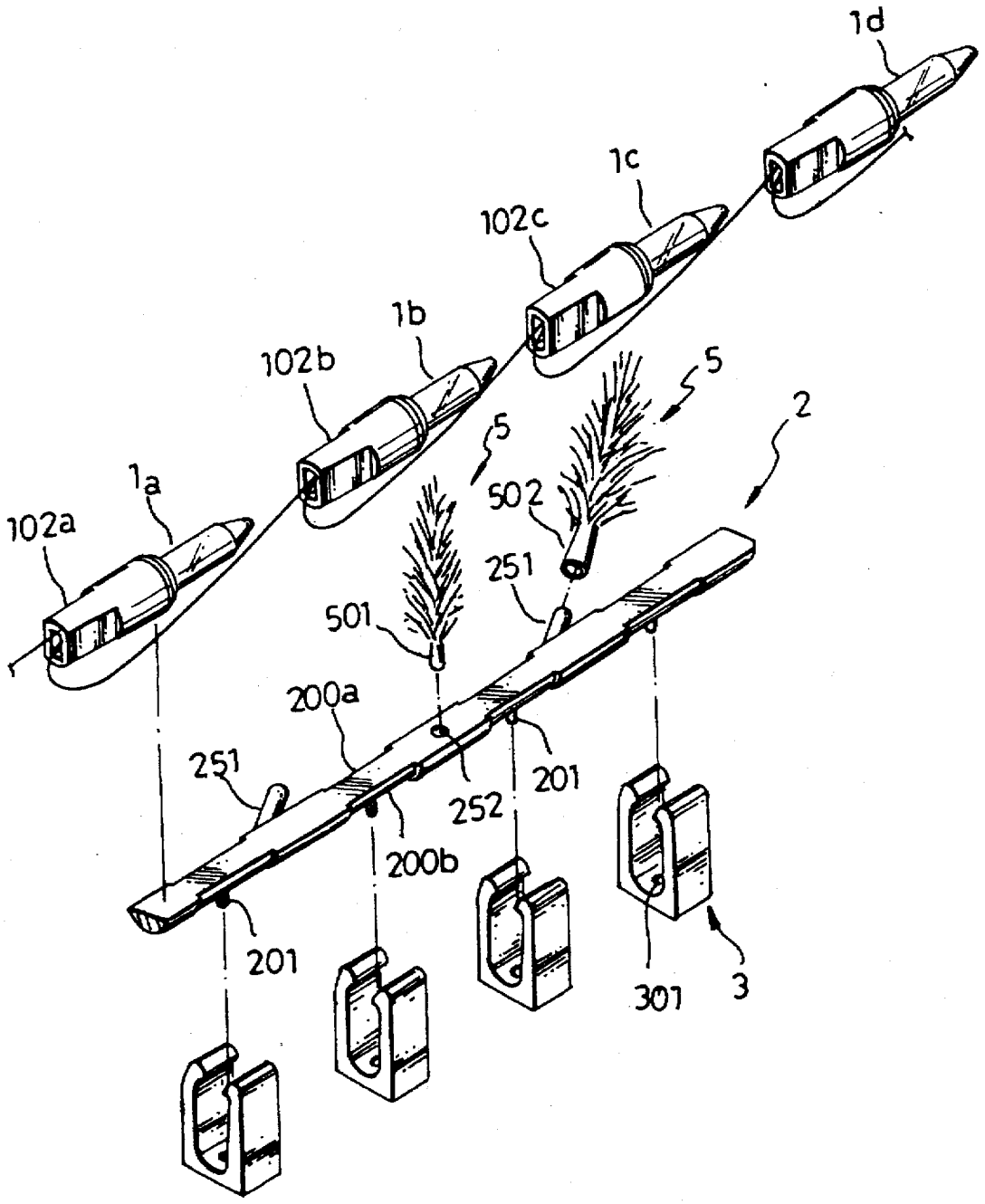
FIG. 10 is a perspective view of the fifth embodiment of the present invention showing its parts in their relative position and the position of decoration, branch or leaf.

Referring now to FIG. 10, yet another embodiment according to the present invention, it is shown with the support assembly with the support 2 are inserted into the open end of each clamping socket as in FIG. 2, wherein along the two longitudinal side of support 2, pillars 251 are equipped between the recesses 200*a* and 200*a* and the decoration (or branch or leaf) 502 with a hole at the lower bottom, or a hole 252 on the flat surface of support 2 and the decoration (or branch or leaf) 501 with a pillar at the lower bottom, the pillars and holes mutually combined so as to form variety decorative lamp string assembly.

To sum up all the foregoing by using the assembling device of this invention, a decorative lamp string assembly with variety of 3-D structure can be achieved. Therefore, there is no doubt that the present invention certainly has utilization value in industrial production.

What I claim is:

1. A decorative lamp string assembly comprising a plurality of lamps each having a lamp socket, electrical wire, a long support with a cross section having a top flat surface and a bottom, a plurality of U-shaped clamping sockets each with two branches defining an open end at free ends of said branches and an inner space into which the support is fitted and said lamp sockets with lamps are clamped against the top flat surface of the support by the two branches of the clamping socket to form said decorative lamp string assembly.

2. A decorative lamp string assembly according to claim 1, wherein the bottom of the cross section of the support is provided with the same shape as that of said clamping socket so as to firmly engage with each other.

3. A decorative lamp string assembly according to claim 1, wherein said support is provided with pillars projecting from its bottom and each clamping socket has a hole in a bottom thereof, the pillars and holes being adapted to mutually combine so as to position and fasten said clamping socket on said support.

4. A decorative lamp string assembly according to claim 1, wherein, along two longitudinal edges of the support, a plurality of flanges are combined with the clamping socket there between, so as to prevent the support from moving.

5. A decorative lamp string assembly according to claim 1, wherein the open ends of said clamping sockets open in a same direction so as to clamp said support, said lamp sockets and electrical wire.

6. A decorative lamp string assembly according to claim 1, wherein each clamping socket has a flange on a middle part of each branch extending into the inner space of the clamping socket to contact with an upper edge of the support, so as to prevent a clamping socket from loosening and coming off.

7. A decorative lamp string assembly according to claim 1, wherein each U-shaped clamping socket has an inwardly directed flange at the free end of each branch in the inner space to contact with the lamp socket, so as to prevent the clamping socket from loosening and coming off.

8. A decorative lamp string assembly according to claim 6, wherein said flange has an inclined surface in the open end direction to facilitate combination.

9. A decorative lamp string assembly according to claim 7, wherein the flanges of the U-shaped clamping socket have inclined surfaces in the open end direction to facilitate combining with said support and said lamp socket.

10. A decorative lamp string assembly according to claim 1, wherein each clamping socket is formed of at least two U-shaped clamping sockets with open ends in a same direction.

11. A decorative lamp string assembly according to claim 10, wherein the clamping sockets with open ends in the same direction have a flange on a middle part of each branch extending into the inner space to contact with the upper edge of the support, so as to prevent the clamping socket from loosening and coming off.

12. A decorative lamp string assembly according to claim 11, wherein the flange on the middle part of each branch has an inclined surface in open end direction to facilitate combination.

13. A decorative lamp string assembly according to claim 10, wherein the clamping sockets with open ends in the same direction have a flange on the free end of each branch in the inner space.

14. A decorative lamp string assembly according to claim 13, wherein the flange on the free end has an inclined surface in open end direction to facilitate combination.

15. A decorative lamp string assembly according to claim 10, wherein the clamping sockets combine with multiple supports to become a structure with various spatial configurations.

16. A decorative lamp string assembly according to claim 10, wherein the clamping sockets together with the plurality of lamps and lamp sockets form a structure of multiple directions and positions of lamps.

17. A decorative lamp string assembly according to claim 1, wherein each clamping socket is formed of at least two U-shaped clamping sockets, having open ends in different directions.

18. A decorative lamp string assembly according to claim 17, wherein the clamping sockets have flanges on a middle part of each branch in the inner space to contact with an upper edge of the support so as to prevent the clamping socket from loosening and coming off.

19. A decorative lamp string assembly according to claim 18, wherein the flange on the middle part of each branch of the clamping sockets has an inclined surface in the open end direction to facilitate combination.

20. A decorative lamp string assembly according to claim 17, wherein the clamping sockets have a flange on the free end of each branch in the inner space.

21. A decorative lamp string assembly according to claim 20, wherein the flange on the free end of each branch of the clamping sockets has an inclined surface in the open end direction to facilitate combination.

22. A decorative lamp string assembly according to claim 1, wherein the support has a plurality of pillars and holes; and branches and leaves are provided having pillars and holes, the pillars and holes of the support and the pillars and holes of the branches and leaves are mutually combined so as to form a decorative lamp string assembly.

23. A decorative lamp string assembly according to claim 1, wherein two ends of the support have a hole and pillar, the pillars and holes at the two ends of a plurality of supports mutually combine so as to form a decorative lamp string assembly.

24. A decorative lamp string assembly according to claim 23, wherein the hole and pillar at the two ends of the support have a flange in the inner space of the hole and a concavity on an outer surface of the pillar so as to prevent the support from coming off.

* * * * *